US006012392A

United States Patent [19]

Norman et al.

[11] Patent Number: 6,012,392

[45] Date of Patent: Jan. 11, 2000

[54] SHAPED CHARGE LINER AND METHOD OF MANUFACTURE

[75] Inventors: Kimball J. Norman, McKinney; Dan W. Pratt, Ft. Worth, both of Tex.

[73] Assignees: Arrow Metals division of Reliance Steel and Aluminum Co., Garland; Owen Oil Tool, Inc., Fort Worth, both of Tex.

[21] Appl. No.: 08/855,806

[22] Filed: May 10, 1997

[51] Int. Cl.[7] ..... F42B 1/02; B22F 3/24

[52] U.S. Cl. ..... 102/307; 102/476; 419/28; 419/38

[58] Field of Search ..... 102/307, 476, 102/306; 166/72, 374, 902; 175/4.52, 4.6; 419/28, 29, 31, 33, 38, 47, 46, 54

[56] References Cited

U.S. PATENT DOCUMENTS

| | | | |
|---|---|---|---|
| 2,870,709 | 1/1959 | Boelter, Jr. | 102/24 |
| 3,025,794 | 3/1962 | Lebourg et al. | 102/24 |
| 3,077,834 | 2/1963 | Caldwell | 102/24 |
| 3,112,700 | 12/1963 | Gehring, Jr. | 102/20 |
| 3,119,178 | 1/1964 | Owen et al. | 102/306 |
| 3,121,389 | 2/1964 | Delacour | 102/20 |
| 3,128,701 | 4/1964 | Rinehart et al. | 102/20 |
| 3,136,249 | 6/1964 | Poulter | 102/24 |
| 3,196,792 | 7/1965 | Charrin | 102/24 |
| 3,255,659 | 6/1966 | Venghiattis | 86/20 |
| 3,375,107 | 3/1968 | Kranz | 75/156.5 |
| 3,948,181 | 4/1976 | Bergstrom | 102/56 |
| 4,080,898 | 3/1978 | Gieske | 102/306 |
| 4,220,687 | 9/1980 | Christopher | 428/546 |
| 4,387,773 | 6/1983 | McPhee | 175/4.6 |
| 4,463,678 | 8/1984 | Weimer et al. | 102/307 |
| 4,474,111 | 10/1984 | Holzhauser | 101/425 |
| 4,474,113 | 10/1984 | Kyro et al. | 102/306 |
| 4,494,461 | 1/1985 | Pryor et al. | 102/464 |
| 4,498,367 | 2/1985 | Skolnick et al. | 86/1 R |
| 4,499,830 | 2/1985 | Majerus et al. | 102/476 |
| 4,638,535 | 1/1987 | Pryor et al. | 29/1.3 |
| 4,649,828 | 3/1987 | Henderson et al. | 102/501 X |
| 4,747,350 | 5/1988 | Szecket et al. | 102/306 |
| 4,766,813 | 8/1988 | Winter et al. | 102/307 |
| 4,794,990 | 1/1989 | Riggs | 166/902 |
| 4,840,654 | 6/1989 | Pryor | 65/18.1 |
| 4,862,804 | 9/1989 | Chawla et al. | 102/309 |
| 4,958,569 | 9/1990 | Mandigo | 102/476 |
| 5,098,487 | 3/1992 | Brauer et al. | 148/432 |
| 5,175,391 | 12/1992 | Walters et al. | 102/307 |
| 5,331,895 | 7/1994 | Bourne et al. | 102/307 |
| 5,792,977 | 8/1998 | Chawla | 102/307 |

OTHER PUBLICATIONS

AMetek Speciality Metal Products Division brochure for *Pfinodal The High Performance Copper Alloy Strip*, 1988.

Mechanical Engineers' Handbook, Edited by Myer Kutz, John Wiley & Sons.

CDA Publication, "*Classification of Copper and Copper Alloys*", 5th Ed., 1952.

Frank Hudson, "*Gunmetal Castings, Their Production, Properties and Application*", published by MacDonald & Company Limited, London, 1967, pp. 51–92 and 119–153.

Fascetta et al entitled "Die Casting Partially Solidified High Copper Content Alloys" appearing in AFS Cast Metals Research Journal, Dec. 1973, pp. 167–171.

J. Campbell entitled "Rheocasting and Thixocasting–A Review of Progress To–date", Foundry Trade Journal, Feb. 27, 1975, pp. 291–295.

Birkhoff et al entitled "Explosives with Lined Cavities", published in the Journal of Applied Physics, vol. 19, Jun. 1948, pp. 563–582.

W. G. Von Holle et al, Temperature Measurement of Shocked Coper Plates and Shaped Charge Jets by Two–Color Ir Radiometry, Journal of Applied Physics, vol. 47, No. 6, Jun. 1976, pp. 2391–2394.

*Primary Examiner*—Peter A. Nelson

*Attorney, Agent, or Firm*—Gardere & Wynne, L.L.P.; Sanford E. Warren, Jr.; Lawerence R. Youst

[57] ABSTRACT

Shaped charge liners are formed from an alloy of nickel, tin, and copper, which is first formed into a powder, and then pressed into strips. The pressed strips of powdered alloy are next sintered and then cold rolled. Thereafter, the powdered, pressed, and sintered alloy strips are formed into shaped charge liners, for example, by stamping. The shaped charge liners may be heat treated either before or after the forming step.

18 Claims, 4 Drawing Sheets

SHAPED CHARGE LINER AND METHOD OF MANUFACTURE

TECHNICAL FIELD

This invention relates generally to shaped charge liners and more particularly to liners for shaped charges of the type used to perforate oil wells and in similar applications, and to methods of manufacturing such liners.

BACKGROUND AND SUMMARY OF THE INVENTION

In the completion of oil wells and the like, a bore hole is first formed in the earth. A casing is then installed in the bore hole and is cemented in place, the function of the casing and the cement being to isolate the various strata of the bore hole one from the other. Next, one or more shaped charges is positioned within the casing and is actuated to perforate the casing and the cement, thereby providing communication between the adjacent formation and the interior of the well. If the formation is oil bearing, oil flows from the formation into the well and is thereafter recovered at the surface.

Shaped charges used in perforating oil wells and the like typically comprise a housing which is cylindrical in shape and which is formed from metal, plastic, rubber, etc. The housing has an open end and receives an explosive material having a concave surface facing the open end of the housing. The concave surface of the explosive material is covered by a liner which functions to close the open end of the housing.

When the explosive material is detonated, a compressive shock wave is generated which collapses the liner. The inner portion of the liner is extruded into a narrow diameter high-speed jet which perforates the casing and the surrounding cement comprising the oil well, etc. The remainder at the liner can form a larger diameter slug which can follow the high-speed jet into the perforation, thereby partially or completely blocking the perforation and impeding the flow of oil there through.

Heretofore, numerous attempts have been made to solve the problems of slugs of liner material interfering with the successful completion of oil wells, etc. For example, liners for shaped charges have been formed from various materials by forming the materials into powders and then pressing the powdered materials into the desired liner shape. Liners comprising compressed powdered materials are very fragile and therefore tend to disintegrate into very small pieces when the shaped charge assembly is actuated. However, liners formed from pressed powdered materials, either sintered or unsintered, tend to be either porous or hydroscopic, or both, and therefore do not provide adequate protection for the explosive material comprising the shaped charge.

Another approach to the problem of slugs of liner material interfering with well completion comprises the use of liners formed from materials having a discrete second phase. The second phase of such materials is selected either to be molten at operating temperatures or to be brittle. In either case, liners formed from such materials are intended to pulverize upon actuation of the explosive material comprising the shaped charge assembly thereby preventing the formation of a slug of liner material. Shaped charge liners of the discrete second phase type have been successful in operation.

The present invention comprises a shaped charge liner and a method of manufacturing shaped charge liners which overcome the foregoing and other difficulties long since associated with the prior art. In accordance with the broader aspects of the invention, a shaped charge liner is formed from an alloy of copper, nickel, and tin. The alloy is first formed into a powder which is pressed into the form of a strip and then sintered. The strip may be cold rolled after sintering. Next, the strip is formed into the desired liner shape, for example, stamping, spinning, and other well known metal working techniques may be used to form the strip into the desired liner shape.

In actual practice, it has been found that liners formed in accordance with the invention do not form slugs when utilized in otherwise conventional shaped charge applications. Thus, the present invention provides a shaped charge liner which provides superior performance.

DESCRIPTION OF THE DRAWINGS

A more complete understanding of the invention may be had by reference to the following Detail Description when taken in conjunction with the accompanying Drawings, wherein.

DETAILED DESCRIPTION

Figure 1:
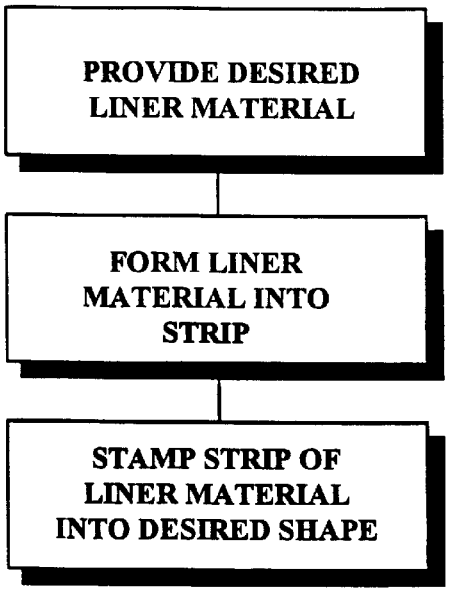
FIG. 1 PRIOR ART
FIG. 1 is a flowchart illustrating a first prior art shaped charge liner manufacturing technique.

Referring now to the Drawings, and particularly to FIG. 1 thereof, there is illustrated what is perhaps the original method of fabricating shaped charge liners. First, the material desired for use in fabricating the liner is selected. At the outset of shaped charge liner manufacturing, copper and alloys of copper were often the desired materials for liner fabrication.

In accordance with the liner fabrication of FIG. 1, the selected liner material is formed into strips. This is accomplished using any of the various well known conventional metal working techniques. For example, the desired material may be melted, cast into ingots, and the resulting ingots either hot worked or cold worked until strips having the desired thickness are achieved.

The resulting strips comprising the desired liner material are then formed to provide shaped charge liners having the desired shape. Typically, one of the various stamping techniques is used to transform strips of the desired liner material into the desired liner shape. However, those skilled in the art will appreciate that any of the various well known metal working techniques, for example, spinning, etc., may be used to fabricate strips of the desired liner material into the desired liner shape.

Shaped charge liners formed from copper and alloys thereof are successful in causing the explosive component of a shaped charge assembly to generate a high-speed jet which penetrates the casing and the surrounding cement of an oil well, etc. However, liners formed from copper and alloys thereof tend to form slugs of liner material which follow the high-speed jet into the perforation, thereby impeding the flow of oil, etc., outwardly from the adjacent formation into the well. Slugs of liner material can also interfere with the removal of the shaped charge assembly from the oil well after it has been actuated to form the perforation.

Figure 2:
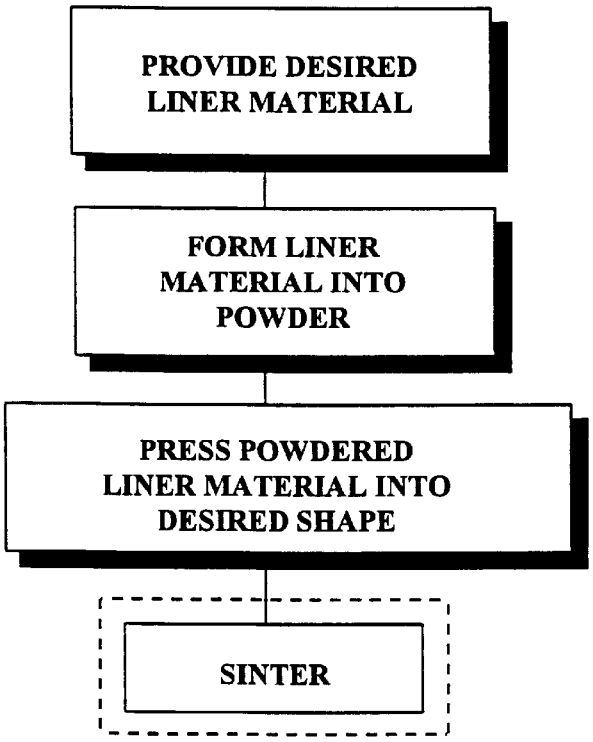
FIG. 2 PRIOR ART
FIG. 2 is a flowchart illustrating a second prior art shaped charge liner manufacturing technique.

FIG. 2 illustrates a method of forming shaped charge liners that was developed to overcome the foregoing problems associated with shaped charge liners fabricated as illustrated in FIG. 1. In accordance with the liner fabrication technique of FIG. 2, a material desired for liner fabrication is selected, and is then formed into a powder. In actual practice, the powder may comprise spheres of the desired liner material. For example, small diameter copper spheres or small diameter lead coated copper spheres may be used. Next, the powdered liner material is pressed to form the desired liner shape. Alternatively, the powdered liner material may be sintered after the pressing step.

Shaped charge liners formed from pressed powders, either sintered or unsintered, are successful in causing the explosive component of a shaped charge assembly to form a narrow diameter high-speed jet which perforates the casing and the surrounding cement of an oil well, etc. Shaped charge liners formed from pressed powders, either sintered or unsintered, are also successful in avoiding problems associated with slugs of liner material in that shaped charge liners so formed shatter during the perforation process and therefore do not form slugs. However, shaped charge liners formed from pressed powders, either sintered or unsintered, tend to be either porous or hydroscopic, or both, and therefore do not provide adequate protection for the explosive component of the shaped charge assembly.

The foregoing problems associated with the shaped charge liner manufacturing techniques illustrated in FIGS. 1 and 2 and described hereinabove in connection therewith led to the development of the shaped charge liner disclosed in U.S. Pat. No. 4,958,569 granted to Mandigo on Sep. 25, 1990. The '569 patent discloses a shaped charge liner manufacturing process wherein liners are wrought from a material comprising a ductile metal matrix and a discrete second phase. The discrete second phase of the liner manufacturing material is selected either to be molten in the operating temperature range of the shaped charge assembly or to be brittle. In either event, the presence of the discrete second phase in the liner material causes the liner to pulverize during operation of the shaped charge assembly, thereby preventing the formation of a slug of liner material.

Figure 3:
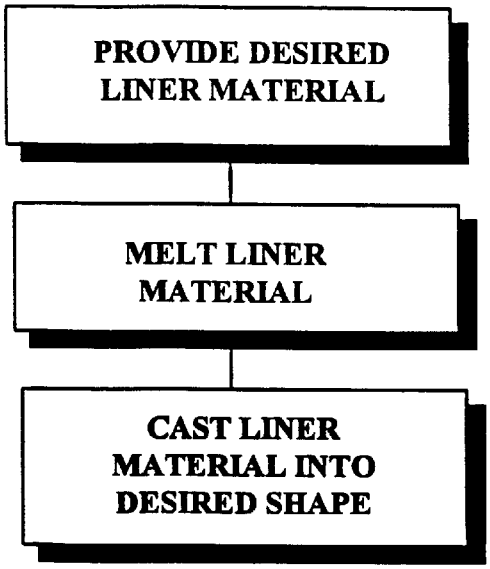
FIG. 3 PRIOR ART
FIG. 3 is a flowchart illustrating a third prior art shaped charge liner manufacturing technique.

FIG. 3 illustrates the adaptation of the liner manufacturing technique of the '569 patent to a different manufacturing process. Having reference to U.S. Pat. No. 5,098,487 granted to Brauer et al. on Mar. 24, 1992, a shaped charge liner material having a discrete second phase which is either molten within the operating temperature range of the shaped charge assembly or brittle, is first melted and is then cast to form the desired liner shape. The melting/casting technique of the '487 patent allows the liner material to incorporate a higher percentage of the discrete second phase then is possible when the technique of the '569 patent is employed.

Figure 4:
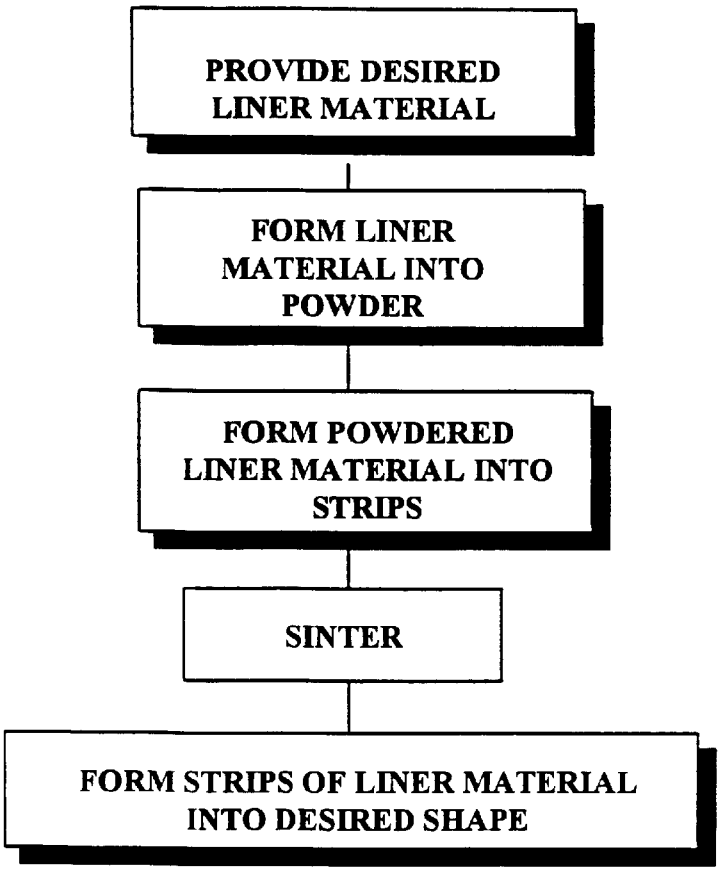
FIG. 4 is a flowchart illustrating a first embodiment of the present invention.

Referring now to FIG. 4, there is disclosed a method of manufacturing shaped charge liners comprising a first embodiment of the present invention. In accordance with the invention, shaped charge liners are formed from an alloy of copper, nickel, and tin. Preferably, the alloy comprises between about 14.5% and about 15.5% nickel, and between about 7.5% and about 8.5% tin, with the remainder comprising copper. More particularly, the alloy may comprise the alloy identified as C72900 and may have a composition of about 15% nickel, about 8% tin, and about 77% copper.

In accordance with the embodiment of the invention illustrated in FIG. 4, the desired liner material is first formed into a powder. In actuality, the desired liner material may be formed into minute spheres, if desired. Next, the powdered liner material is pressed into strips. The strips comprising the desired liner material are then sintered. Both the pressing and sintering steps of the embodiment of the invention illustrated in FIG. 4 may be carried out using commercially available apparatus which is well known in the art. The strips comprising the desired liner material are cold rolled after sintering.

The strips of the desired liner material are next formed into the desired liner shape. One advantageous manufacturing technique useful in the practice of the invention comprises stamping because, as is well known, stamping comprises a very economical type of metal working. Other well known and commonly employed types of metal working, for example, spinning, etc., may be used to transform the strips comprising the desired liner material into the desired liner shape.

Figure 5:
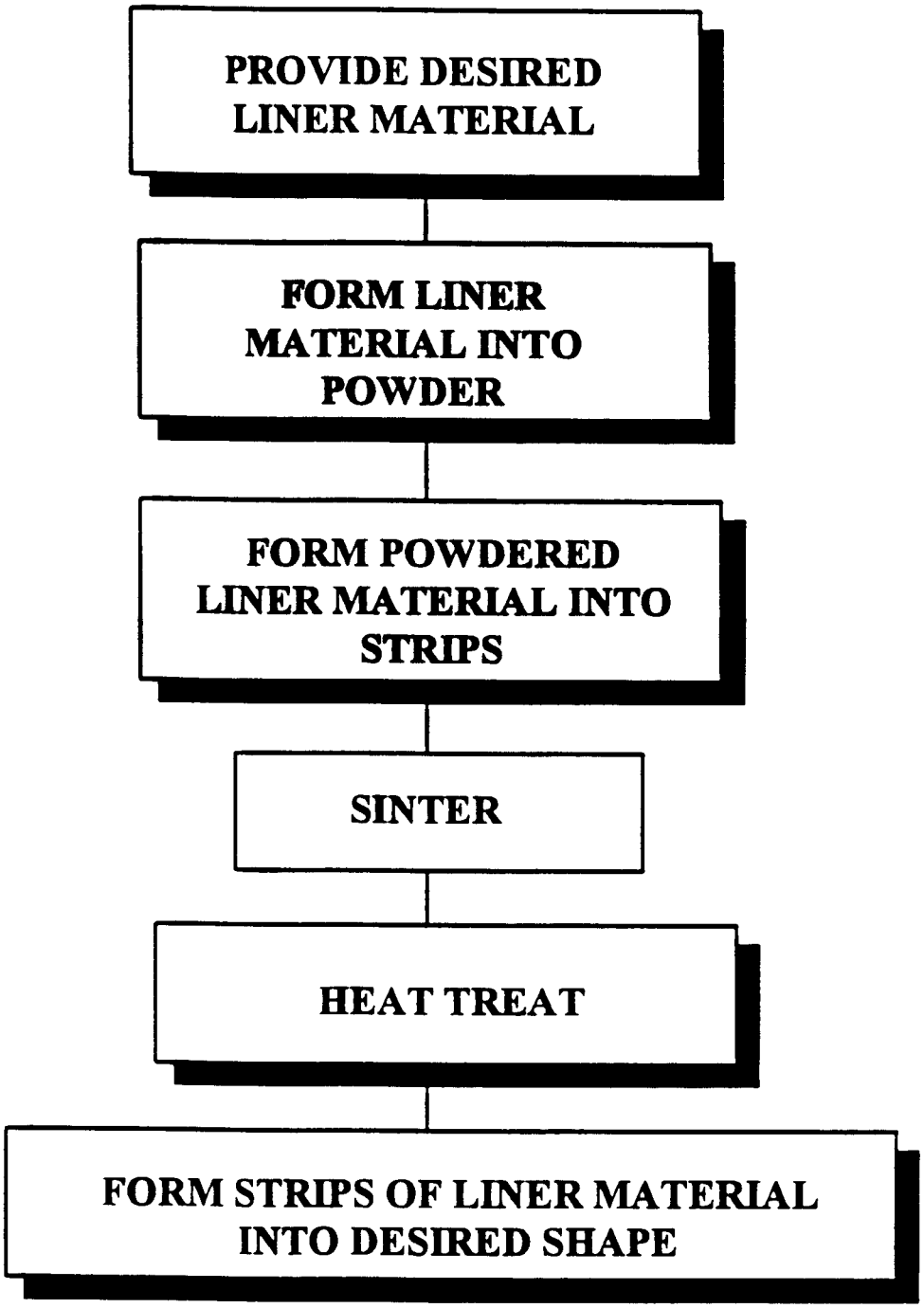
FIG. 5 is a flowchart illustrating a second embodiment of the present invention.

FIG. 5 illustrates a method of manufacturing shaped charge liners comprising a second embodiment of the invention. The method of FIG. 5 is identical to FIG. 4 except that the strips comprising the desired liner material are heat treated prior to being formed into the desired liner shape. Various well known heat treating processes may be employed in carrying out the heat treating step of FIG. 5 in order that the resulting shaped charge liner will have physical and metallurgical properties appropriate to particular applications of the invention.

Figure 6:
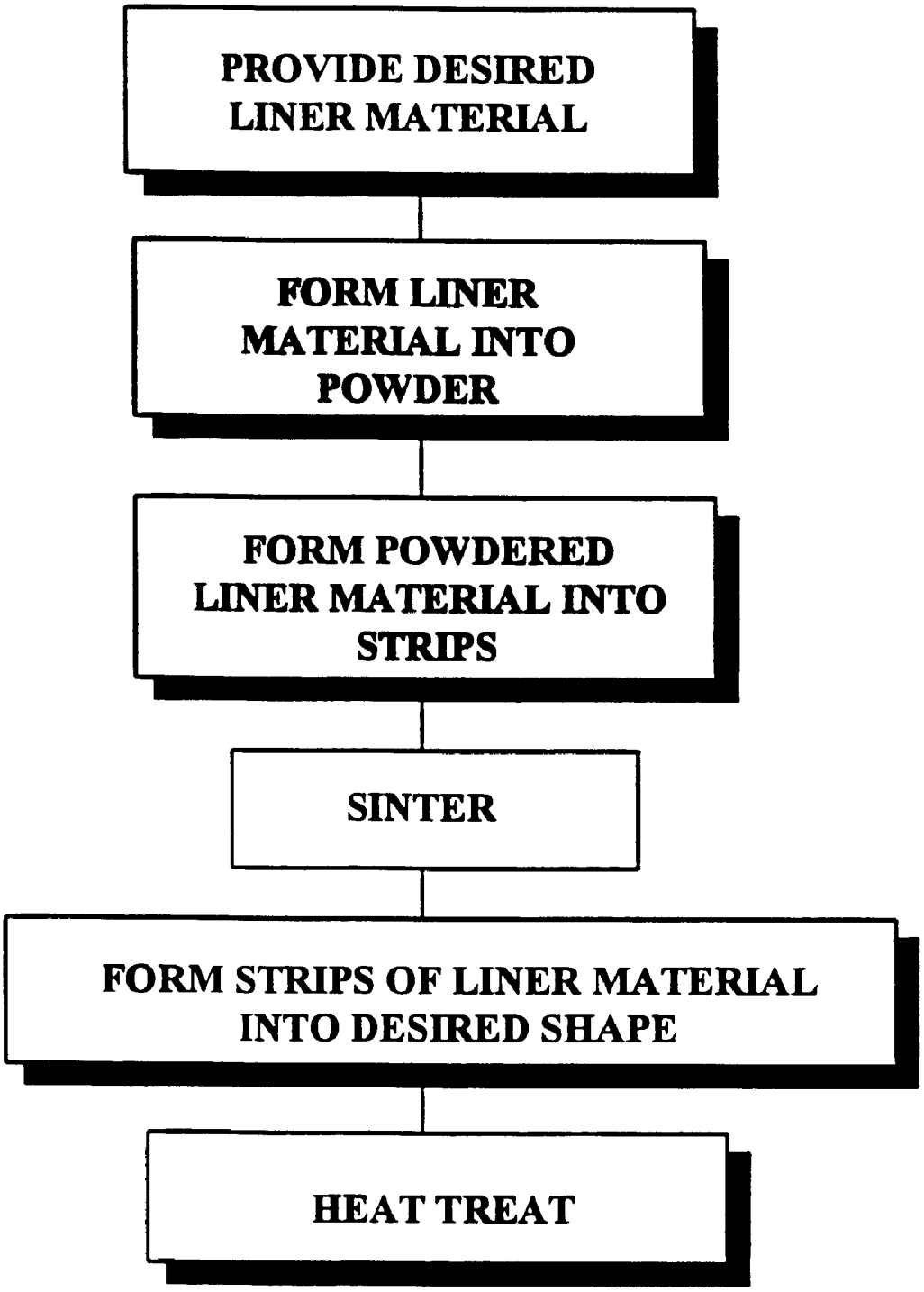
FIG. 6 is a flowchart illustrating a third embodiment of the present invention.

FIG. 6 illustrates a method of manufacturing shaped charge liners comprising a third and preferred embodiment of the invention. The shaped charge liner manufacturing method of FIG. 6 is identical to the method of FIG. 4 except that the shaped charge liners are heat treated after having been formed from the strips of liner material. The heat treating step of FIG. 6 may be carried out using any of various well known heat treating techniques, and is employed in the method of FIG. 6 in order that the shaped charge liners fabricated in accordance therewith will have the physical and metallurgical properties appropriate to particular applications of the inventions.

In particular, the method of FIG. 6 is advantageous in that the shaped charge liners remain dimensionally stable during the heat treating process. By heat treating the shaped charge liners following manufacture, it is possible to selectively increase the yield strength thereof. For example, by means of the present invention it is possible to achieve a hardness of Vickers 405 and a yield strength of between about 150 ksi and about 170 ksi. This is important because the ability to control yield strength allows customization of shaped charge jet development, allowing for jet optimization.

The practice of the present invention may advantageously be accomplished utilizing the high performance copper strips available from AMETEK, Inc., Specialty Metal Products Division, 21 Toelles Road, Wallingford, Conn. 06492-7607, and sold by that company under the trademark "PFINODAL". The "PFINODAL" copper strips available from AMETEK, Inc. comprise the C72900 alloy which is formed into a powder, pressed into strips, sintered and then rolled to the desired thickness. Thus, by means of the "PFINODAL" copper alloy strips, the shaped charge liners of the present invention may be manufactured by shaping "PFINODAL" strips into the desired liner shape using stamping or other commercially available and well known metal working techniques.

In the practice of the invention, shaped charge liners manufactured in accordance therewith function to cause the explosive component of shaped charge assemblies to form a narrow diameter high-speed jet which is effective in perforating the steel casings and surrounding cement of oil wells, etc., to provide communication between the bore of the well and the adjacent formation. Shaped charge liners comprising the present invention do not form slugs of liner material, thereby overcoming problems long since associated with the prior art. Surprisingly, when liners comprising the present inventions are utilized with conjunction with otherwise conventional shaped charge assemblies, conventional testing techniques reveal very little liner residue in any form. Thus, the use of the present invention results in significant advantages over the prior art.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

We claim:

1. A shaped charge liner formed entirely from a predetermined alloy which is first powdered, then pressed into strips, then sintered, then cold rolled, and which is thereafter formed into the desired liner shape.

2. The shaped charge liner according to claim 1 wherein the alloy comprises between about 14.5% and about 15.% nickel; between about 7.5% and about 8.5% tin, with the balance being copper.

3. The shaped charge liner according to claim 2 wherein the alloy comprises about 15% nickel, about 8% tin, and about 77% copper.

4. The shaped charge liner according to claim 1 wherein the shaped charge liner is formed from the powdered, pressed, sintered, and rolled alloy strips by stamping.

5. The shaped charge liner of claim 1 wherein the liner is heat treated after being formed, thereby selectively altering liner yield strength.

6. The shaped charge liner according to claim 5 wherein the liner is heat treated to provide a yield strength of up to 170 ksi.

7. The shaped charge liner of claim 1 wherein the liner does not form a slug of liner material upon detonation of the associated shaped charge and therefore does not form debris in the resulting perforation.

8. A method of manufacturing shaped charge liners comprising the steps of:

providing a predetermined alloy;

forming the alloy into a powder;

pressing the powdered alloy into strips;

sintering the pressed strips; and forming the powdered, pressed, and sintered alloy strips into a desired liner shape.

9. The method of claim 8 wherein the strips are cold rolled after the sintering step.

10. The method of manufacturing shaped charge liners according to claim 8 further including the step of heat treating the powdered, pressed, and sintered alloy strips prior to the step of forming the strips into shaped charge liners.

11. The method of manufacturing shaped charge liners according to claim 8 further including the step of heat treating the shaped charge liners after the forming step.

12. The method of manufacturing shaped charge liners according to claim 11 wherein the heat treating step provides a predetermined liner yield strength.

13. The method of manufacturing shaped charge liners according to claim 11 further characterized by mounting the liner in a shaped charge assembly and wherein the heat treating step results in optimization of the jet resulting from operation of the shaped charge assembly.

14. The method of manufacturing shape charge liners according to claim 11 wherein the heat treating step results in a liner having an ultimate hardness of up to Vickers 405 and a yield strength of up to 170 ksi.

15. The method of manufacturing shaped charges liners according to claim 8 wherein the resulting shaped charge liner does not produce a slug of liner material upon actuation of the shaped charge assembly having the shaped charge liner mounted therein.

16. The method of manufacturing shaped charge liners according to claim 8 wherein the step of providing an alloy comprising nickel, tin, and copper is further characterized by providing an alloy comprising between about 14.% and about 15.% nickel, and between about 7.5% and about 8.5% tin, with the balance being copper.

17. The method of manufacturing shaped charge liners according to claim 16 wherein the step of providing an alloy is further characterized by providing an alloy comprising about 15% nickel, about 8% tin, and about 77% copper.

18. The method of manufacturing shaped charge liners according to claim 17 wherein the step of forming the powdered, pressed, and sintered strips into shaped charge liners is carried out by stamping.

* * * * *